US005201261A

United States Patent [19]

Kayukawa et al.

[11] Patent Number: 5,201,261

[45] Date of Patent: Apr. 13, 1993

[54] PISTON COUPLING MECHANISM FOR A SWASH PLATE COMPRESSOR

[75] Inventors: Hiroaki Kayukawa; Kazuya Kimura; Kenji Takenaka, all of Kariya, Japan

[73] Assignee: Kabushiki Kaisha Toyoda Jidoshokki Seisakusho, Kariya, Japan

[21] Appl. No.: 799,417

[22] Filed: Nov. 27, 1991

[30] Foreign Application Priority Data

Nov. 29, 1990 [JP] Japan ..... 2-128823[U]

[51] Int. Cl.[5] ..... F01B 3/00

[52] U.S. Cl. ..... 92/71; 92/12.2; 74/60; 417/269

[58] Field of Search ..... 92/12.2, 71; 417/269; 74/60

[56] References Cited

U.S. PATENT DOCUMENTS 960,575 6/1910 Negley ..... 74/60

1,430,275 9/1922 Almen ..... 74/60

2,230,839 2/1941 Hulsebos ..... 74/60

FOREIGN PATENT DOCUMENTS 0011165 1/1991 Japan ..... 417/269

*Primary Examiner*—Thomas E. Denion

*Attorney, Agent, or Firm*—Brooks Haidt Haffner & Delahunty

[57] ABSTRACT

A piston coupling mechanism for a swash plate type compressor is disclosed. A disk-shaped swash plate is pivotally mounted on a drive shaft for rotation together with the drive shaft. A plurality of pistons are mounted to the peripheral portion of the swash plate. Each piston is arranged to linearly reciprocates in accordance with the rotation of the swash plate. Connecting members are provided for coupling the piston and the swash plate. The connecting members are arranged to move at least in a radial direction of the drive shaft.

7 Claims, 10 Drawing Sheets

PISTON COUPLING MECHANISM FOR A SWASH PLATE COMPRESSOR

BACKGROUND OF THE INVENTION

1. Field of the Invention

The present invention relates to a piston coupling mechanism for a swash plate type compressor. More particularly, it relates to an arrangement for coupling the pistons to the swash plate in a variable capacity compressor.

2. Description of the Related Art

A swash plate type compressor has a rotary plate which is pivotally supported on a drive shaft and rotates integrally with the drive shaft. A swash plate is provided on the rotary plate to be rotatable relative thereto, and is coupled to a plurality of single head pistons by corresponding piston rods. Further, a swash plate baffle mechanism prevents the swash plate from turning while the rotary plate is rotating to maintain the accurate reciprocation of the piston.

To simplify the structure of the above-described swash plate type compressor, a compressor as disclosed in Japanese Unexamined Patent Publication No. 60-175783 has been proposed. In the disclosed compressor, each piston includes hemispherical shoes 100 that are fitted in a spherical recess 103 at a neck 102 of the piston 101 to be supported there, as shown in FIG. 12. The flat end surfaces of the shoes 100 contact a swash plate 104. With the supporting structure of the shoes 100, the piston 101 can be reciprocated in the axial direction in accordance with the swinging motion of the swash plate 104. This swash plate type compressor therefore does not need the rotary plate and the swash plate baffle mechanism, thus significantly simplifying the mechanism.

As the swash plate 104 is turned, however, a side load is applied to the piston 101 from the swash plate 104 via the shoes 100. The load then causes a one-sided abutting between the piston 101 and a cylinder 105, which may wear out the portion where the piston 101 abute against the cylinder 105 or may cause that portion to be burnt.

SUMMARY OF THE INVENTION

It is therefore an object of the present invention to provide a swash plate compressor designed to prevent a piston from wearing out and being burnt so as to have a long service life.

It is another object of this invention to provide a piston coupling mechanism capable of reducing a side load applied to a piston from a swash plate.

To achieve the above objects, the present invention includes a drive shaft, a disk shaped swash plate pivotally mounted on the drive shaft for rotation together with the rotary shaft, a plurality of pistons, each piston being arranged to linearly reciprocated in accordance with the rotation of the swash plate, and coupler means for coupling the pistons to the swash plate, said coupler means being arranged to move at least in a radial direction relative to the drive shaft.

DETAILED DESCRIPTION OF THE PREFERRED EMBODIMENT

Figure 1:
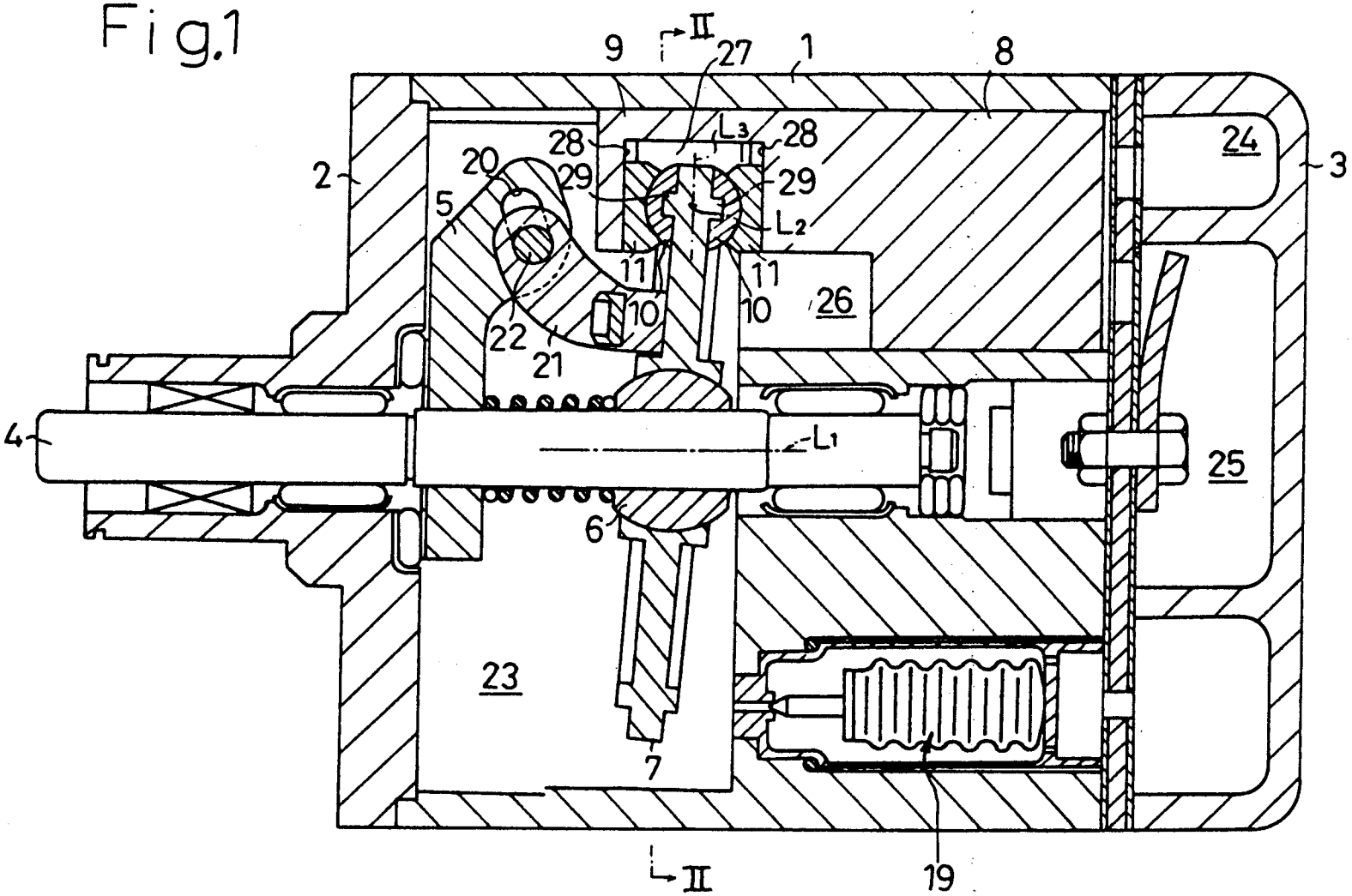
FIG. 1 is a side cross-sectional side view of a compressor in accordance with the present invention.

A first embodiment of the present invention will now be described referring to FIGS. 1 through 4.

A front housing 2 and a rear housing 3 are securely connected to the front and back of a cylinder block 1 of a compressor. The cylinder block 1 has a plurality of cylinders 26 each of which receives a single head piston 8. A rotary shaft 4 is rotatably supported by the cylinder block 1 and front housing 2. In the front housing 2, a lug plate 5 is fixed to the rotary shaft 4 for rotation therewith. The lug plate has an elongated hole 20 in its distal end.

A spherical bushing 6 is supported slidably on the rotary shaft 4. The swash plate 7 is pivotally supported by a bushing 6 and rotates integrally with the rotary shaft 4. A linkage 21 is attached to the swash plate 7, to couple the swash plate 7 to the lug plate 5 via a pin 22. The pin 22 is carried by the proximal end of the linkage 21, and permits the swash plate 7 to tilt relative to the axis of rotary shaft 4. More particularly, the tilting action of the swash plate 7 is guided by the sliding guide action of the elongated hole 20 and the pin 22 as well as the sliding action and the supporting action of the bushing 6.

Each cylinder 26, is bored through the cylinder block 1 between a crank chamber 23, an inlet chamber 24 and a discharge chamber 25. The inlet and discharge chambers are located in the rear housing 3. The piston 8 has a neck 9 provided with an opening 27 through which the swash plate 7 moves. Arcuate recesses 28 are formed in each side wall facing the opening 27. A ring shaped support rail 29 is formed on the outer periphery of the swash plate 7 such that it protrudes somewhat from each side of the swash plate. The support rail is positioned such that it moves through the opening 27. The radial center of the support rail 29 is coincident with the axis L1 of the rotary shaft 4.

Figure 2:
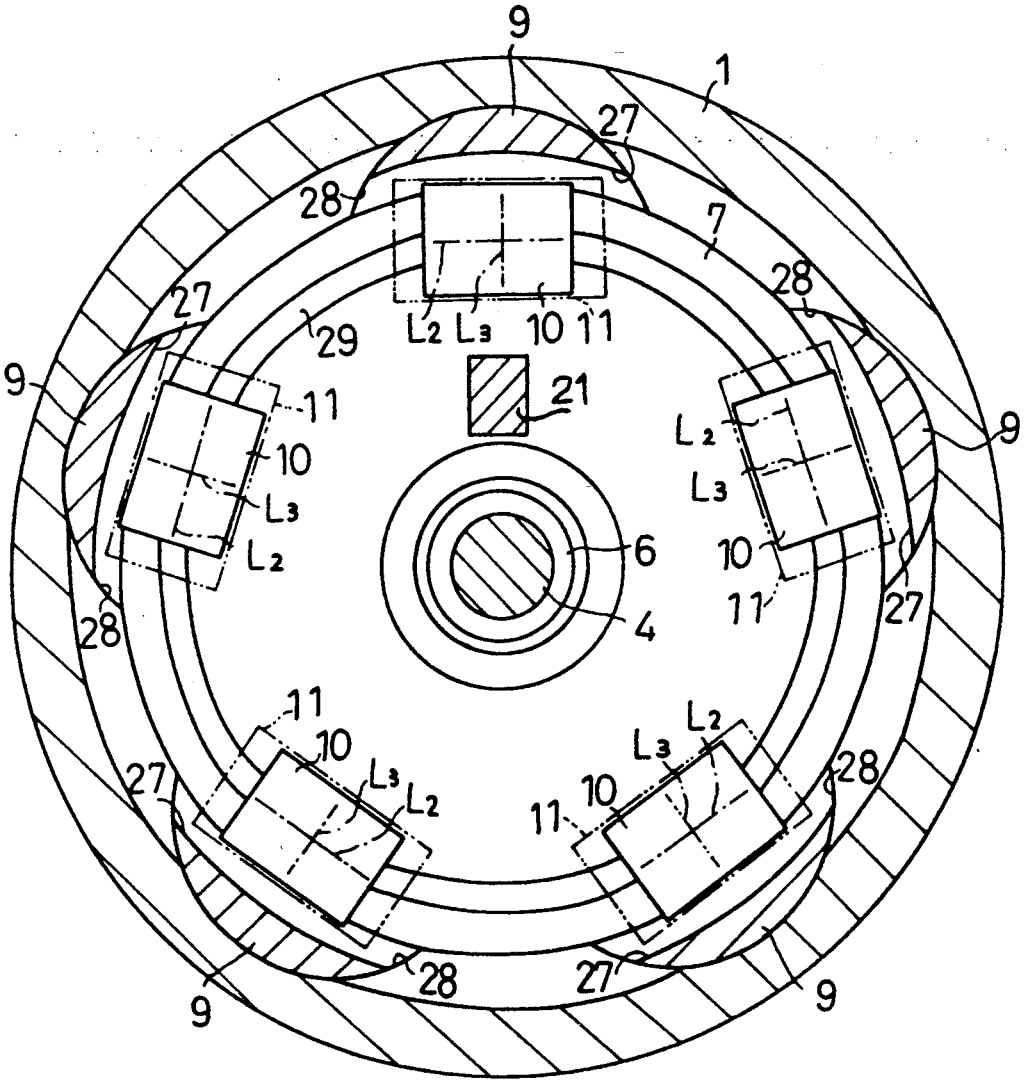
FIG. 2 is a cross-sectional view taken along the line II—II in FIG. 1.
Figure 3:
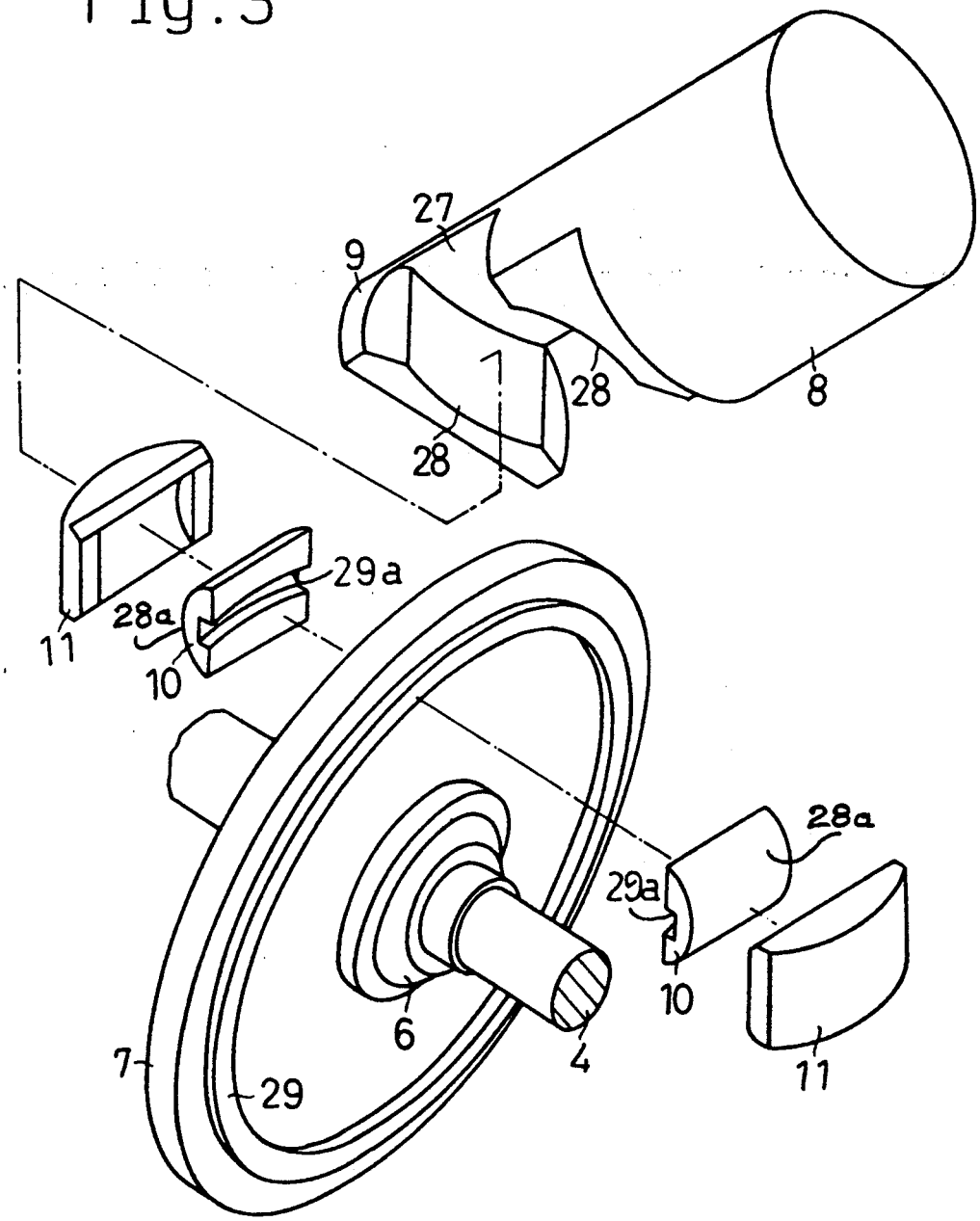
FIG. 3 is an exploded perspective view of the essential portions of the swash plate-piston coupling mechanism.

As shown in FIGS. 1 and 2 a plurality of pistons 8 having necks 9 are arranged at equal angular intervals about the rotary shaft 4. Each side of the support rail 29 is supported by a pair of coupling members 10 and 11 that effectively act as bushings. Each pair of coupling members is disposed between the neck 9 of each piston 8 and an associated side of the support rail 29. As shown in FIG. 3, the second coupling members 10 are formed substantially in the shape of an arcuate portion of a cylindrical shape with its flat (inner) surface 29*a* slidably engaging the support rail 29. The first coupling member 11 is positioned between the arcuate recess 28 and the cylindrical (outer) surface 28*a* of the second coupling member 10. Thus, the inner and outer surfaces of the coupling member 11 are shaped to correspond to the shapes of the cylindrical outer surface of the coupling member 10 and the arcuate recess 28 respectively.

The second coupling members 10 are arranged such that their axes L2 (FIGS. 1 and 2) coincide with and lie on the centerline of the pair of support rails 29. Further, the axis L3 of the arcuate recess 28 is set to cross the axis L2. Both coupling members 10 and 11 are therefore always slidable in the opening 27 irrespective of the rotational angle of the swash plate.

When the swash plate 7 is held tilted, it will rotate to form an elliptical locus relative to the rotary shaft 4. The coupling member 10 therefore moves along the elliptical rotational locus that the outer periphery of the swash plate 7 makes as it rotates. Consequently, the distance between the coupling member 10 and the rotational axis L1 (FIG. 1) changes. This distance variation is allowed by the up-and-down sliding displacement of the coupling member 11 with respect to the arcuate recess 28.

The rotational motion of the swash plate 7 is converted into reciprocal motion of the piston 8 via the coupling members 10 and 11, so that the piston 8 reciprocates in the cylinder 26. Accordingly, the inlet gas sucked into the cylinder 26 from the inlet chamber 24 is compressed and discharged to the discharge chamber 25. The stroke of the piston 8 changes in accordance with changes in the tilt angle of the swash plate 7. The tilt angle of the swash plate is typically controlled by controlling the pressure in the crank chamber 23 relative to the intake pressure in the cylinder 26. The pressure in the crank chamber 23 is controlled by an electromagnetic control valve mechanism 19 in the cylinder block 1. As a result, the inclination of the swash plate 7 changes to alter the capacity of the compressor.

Figure 4:
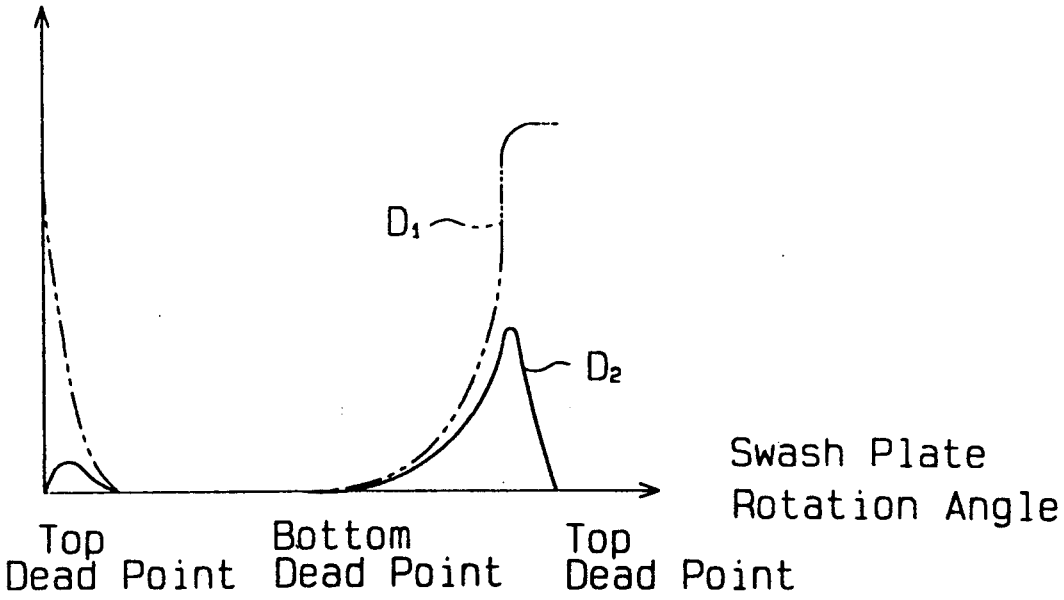
FIG. 4 is a graph showing a side load acting between the swash plate and the piston neck as a function of piston stroke position.

By permitting the distance in the radial direction between the coupling member 10 and the rotational axis L1 to vary, the side load applied to the neck 9 of the piston 8 due to the rotation of the swash plate 7 is lowered. The graph in FIG. 4 represents the side load applied to the piston 8 from the swash plate 7. A curve D1 indicated by a two-dot chain line represents the side load as applied in a conventional rocking swash plate type compressor. The solid-lined curve D2 is the curve of a side load according to this embodiment. As is apparent from a comparison of the two curves D1 and D2, this embodiment significantly reduces the side load created by the sliding action of the coupling member 11 in the radial direction of the swash plate 7.

The sliding of the first coupling member 11 with respect to the piston 8 is restricted to the radial direction of the swash plate 7, while the sliding of the second coupling member 10 is restricted to the circumferential direction of the swash plate 7. Therefore, the piston 8 will not roll as the swash plate 7 rotates. This prevents the neck 9 of the piston 8 from interfering with the peripheral edge of the swash plate 7, thus eliminating the need to additionally provide a mechanism for preventing the rolling of the piston 8.

The present invention is not limited to the above-described embodiment. Rather, it may be modified in a variety of ways as, for example, are seen in the embodiments shown in FIGS. 5 to 11.

Figure 5:
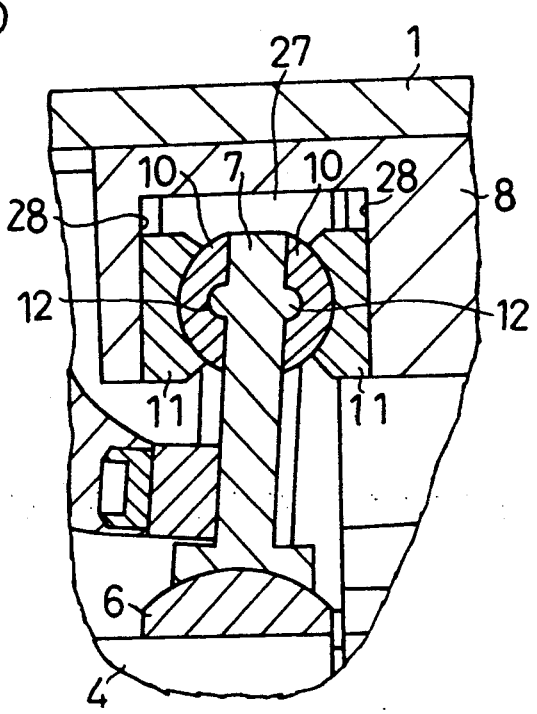
FIG. 5 is a cross-sectional side view of an alternative embodiment of the swash plate-piston coupling mechanism that includes a support rail.
Figure 6:
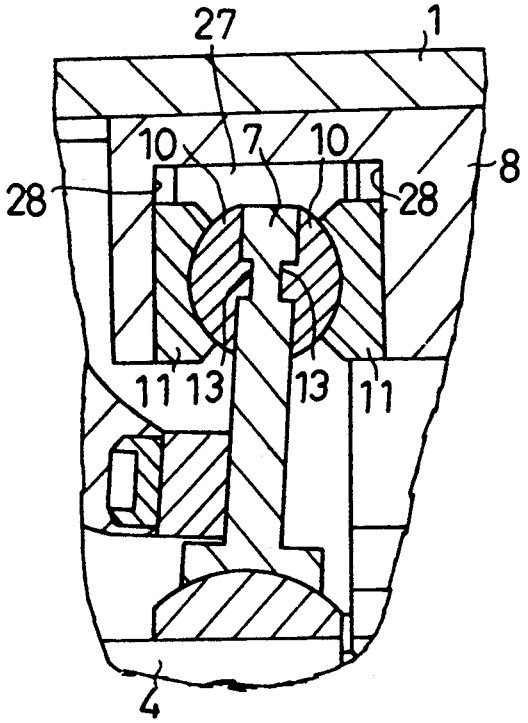
FIG. 6 is a cross-sectional side view of an another alternative embodiment of the swash plate-piston coupling mechanism that includes a support groove in place of the support rail.

The support rail 12 in the embodiment shown in FIG. 5 is designed to have a semicircular cross section, while the embodiment shown in FIG. 6 has a ring-shaped support groove 13 in place of the support rail 12. In each case, the second coupling member 10 is adapted to match the support rail/groove configuration. Of course a variety of other geometries could be used for the support rail as well.

Figure 7:
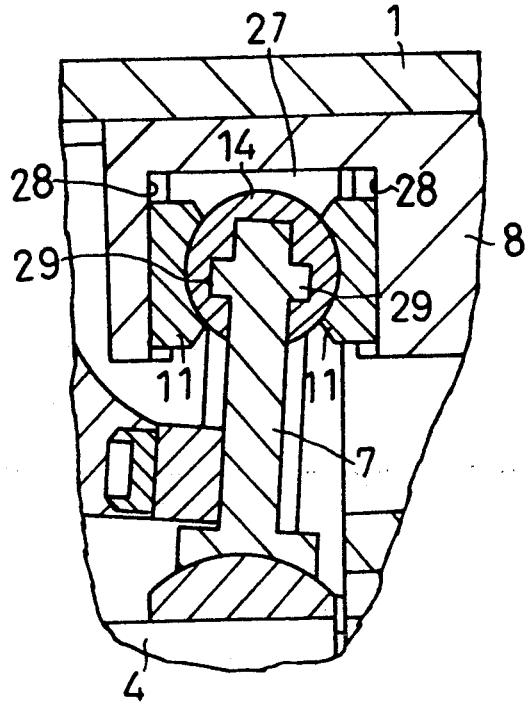
FIG. 7 is a cross-sectional side view of another embodiment of the coupling mechanism.

The embodiment in FIG. 7 employs a single integral first coupling member 14 in place of the pair of independent second coupling members 10 located on opposite sides of the swash plate 7 as set forth in the previous embodiments.

Figure 8:
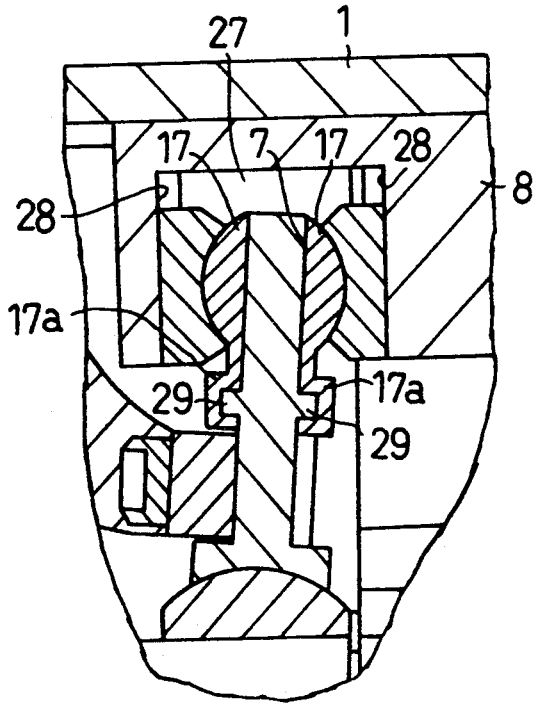
FIG. 8 is a cross-sectional side view of another embodiment of the coupling mechanism.

In the embodiment in FIG. 8 the support rail 29 is provided outside the opening 27 of the piston 8. In this embodiment, the second coupling members 17 each include a leg 17*a* which has an internal groove arranged to receive the support rail 29. The first coupling members 11 are of the same type as in the preceding embodiments. This design permits the cross-sectional area of the support rail 29 to be enlarged, which improves the load resistance performance.

Figure 9:
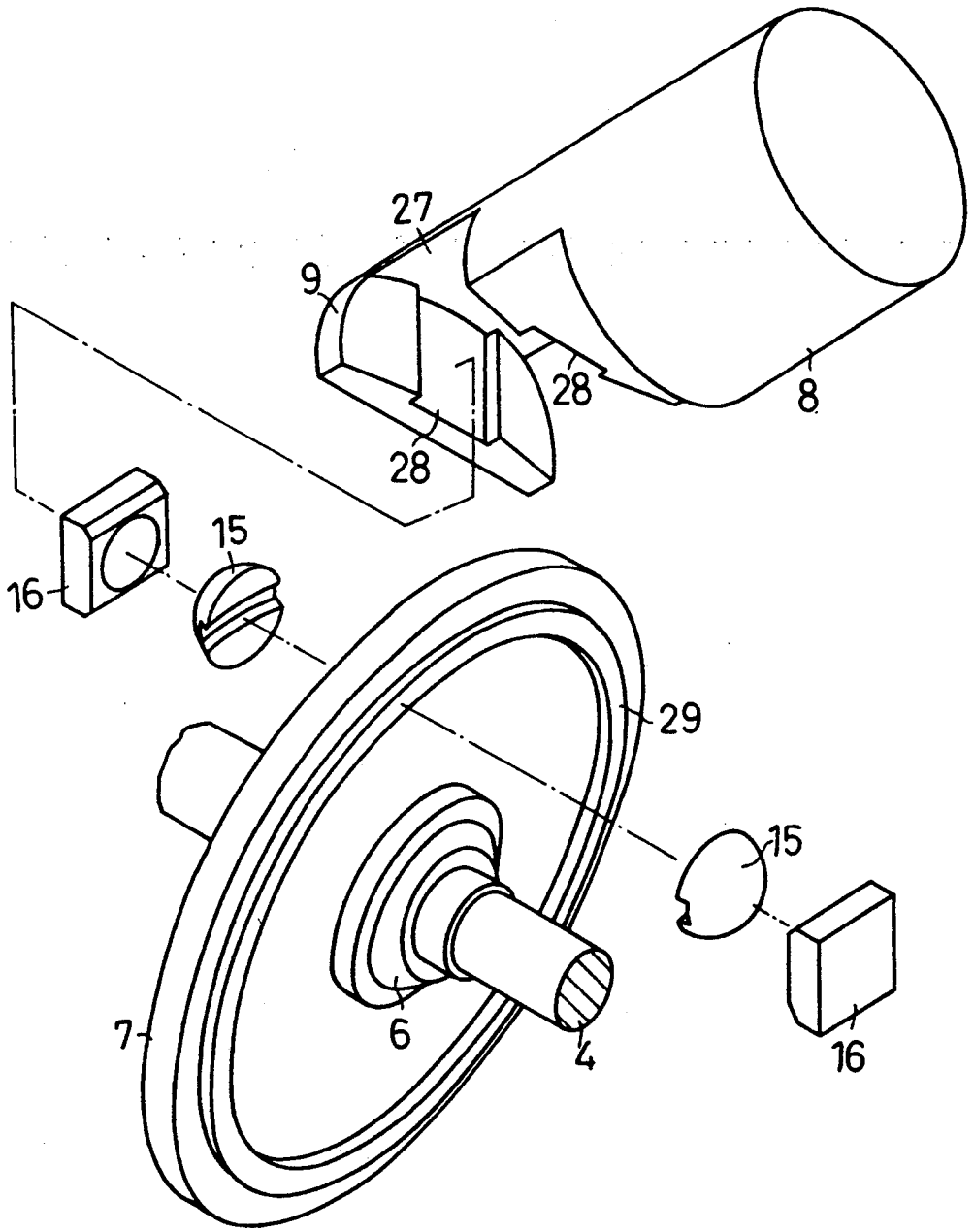
FIG. 9 is an exploded perspective view of another embodiment of the coupling mechanism.

In the embodiment in FIG. 9, the second coupling members 15 have a substantially hemispherical shape so that the hemispherical surface of each coupling member 15 is fitted in another coupling member 16. In this embodiment, the recess 28 at the neck 9 of the piston 8 should simply have a shape which permits the coupling member 16 to be slidably guided in the radial direction of the swash plate 7. It is therefore unnecessary for the recess 28 and the coupling member 16 to have a special guiding relationship to ensure sliding rotation therebetween.

Figure 10:
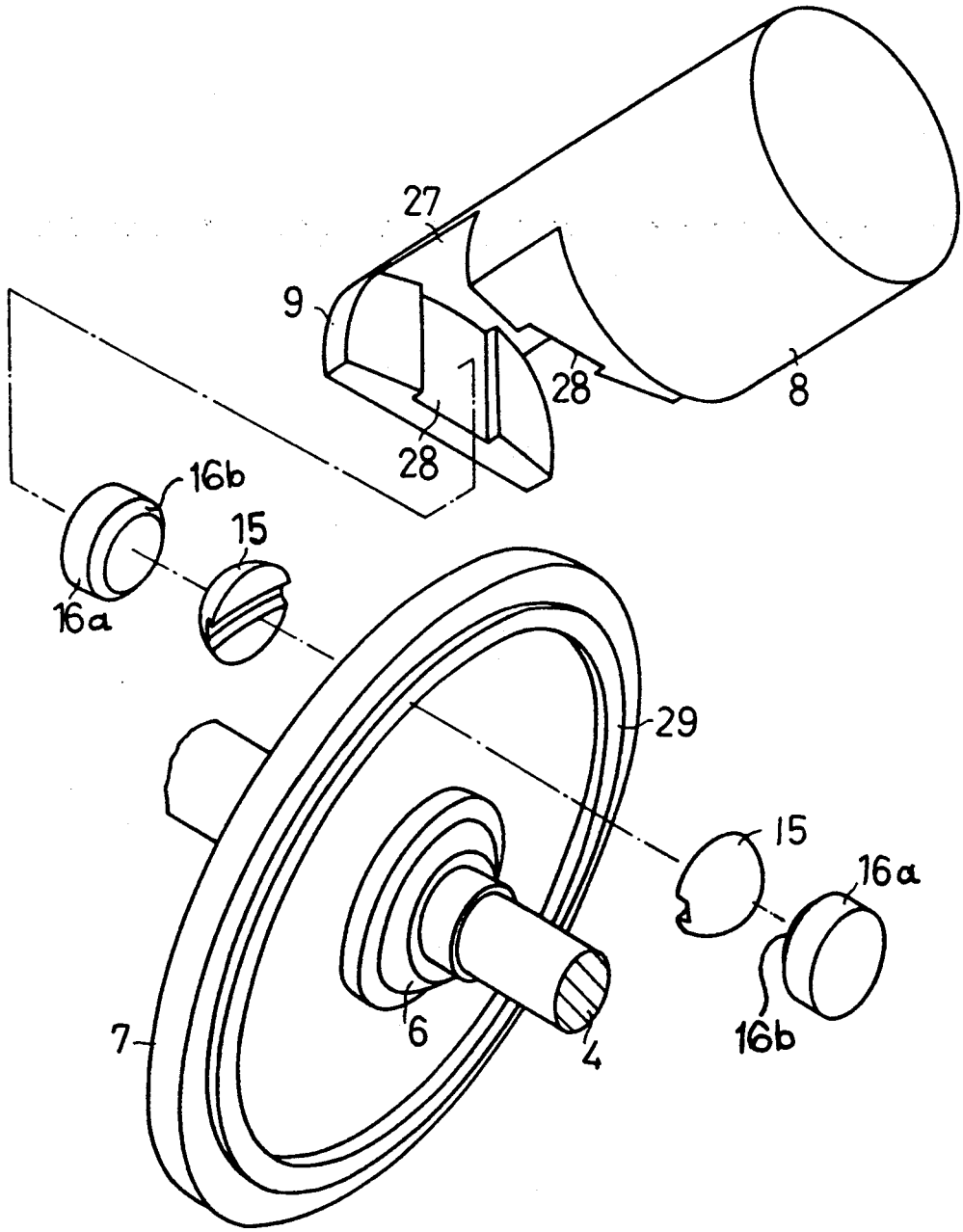
FIG. 10 is an exploded perspective view of yet another embodiment of the coupling mechanism.

The coupling member 16*a* may be designed to have a frustum shaped tip 16*b* as shown in FIG. 10.

Figure 11:
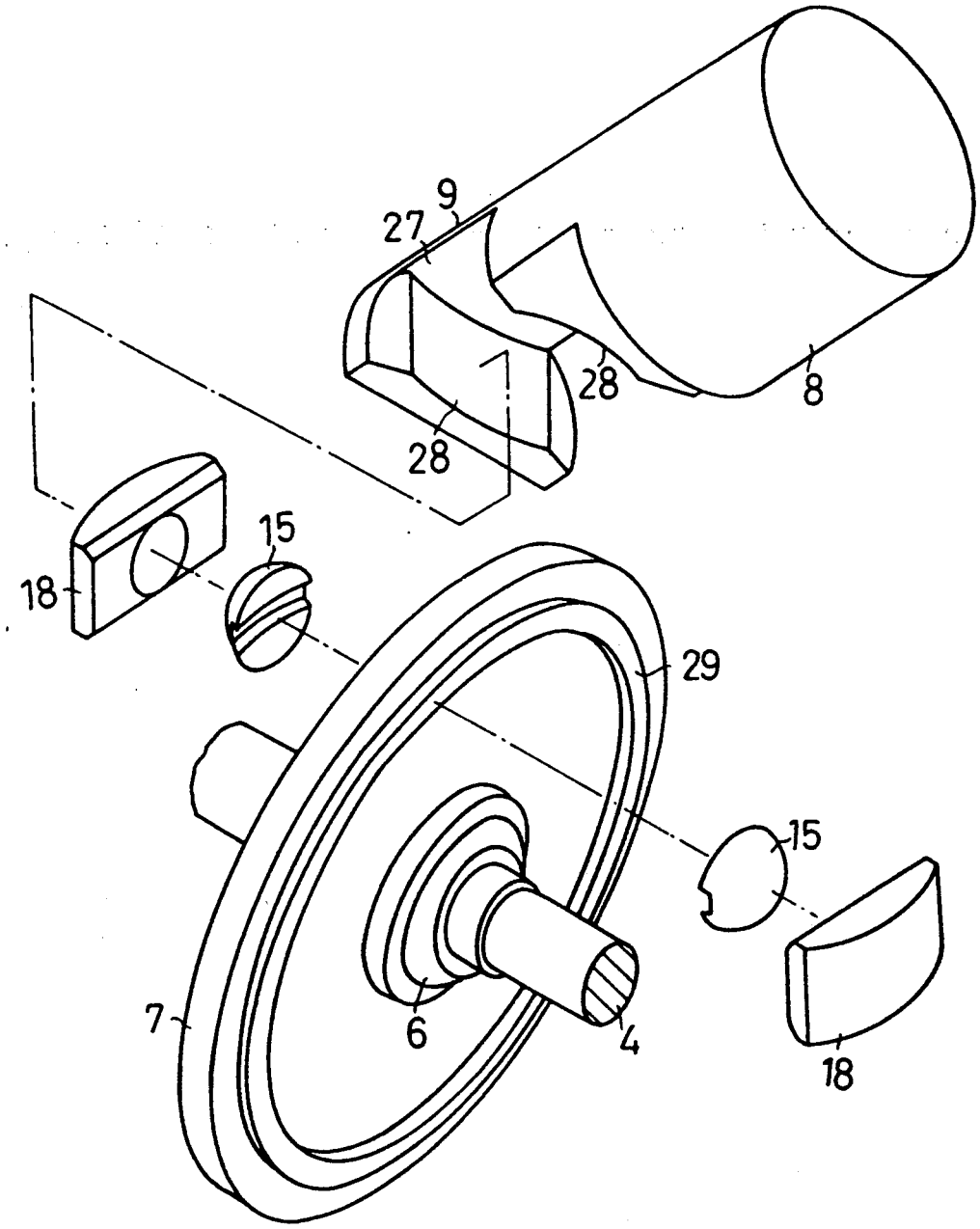
FIG. 11 is an exploded perspective view of another embodiment of the coupling mechanism.
Figure 12:
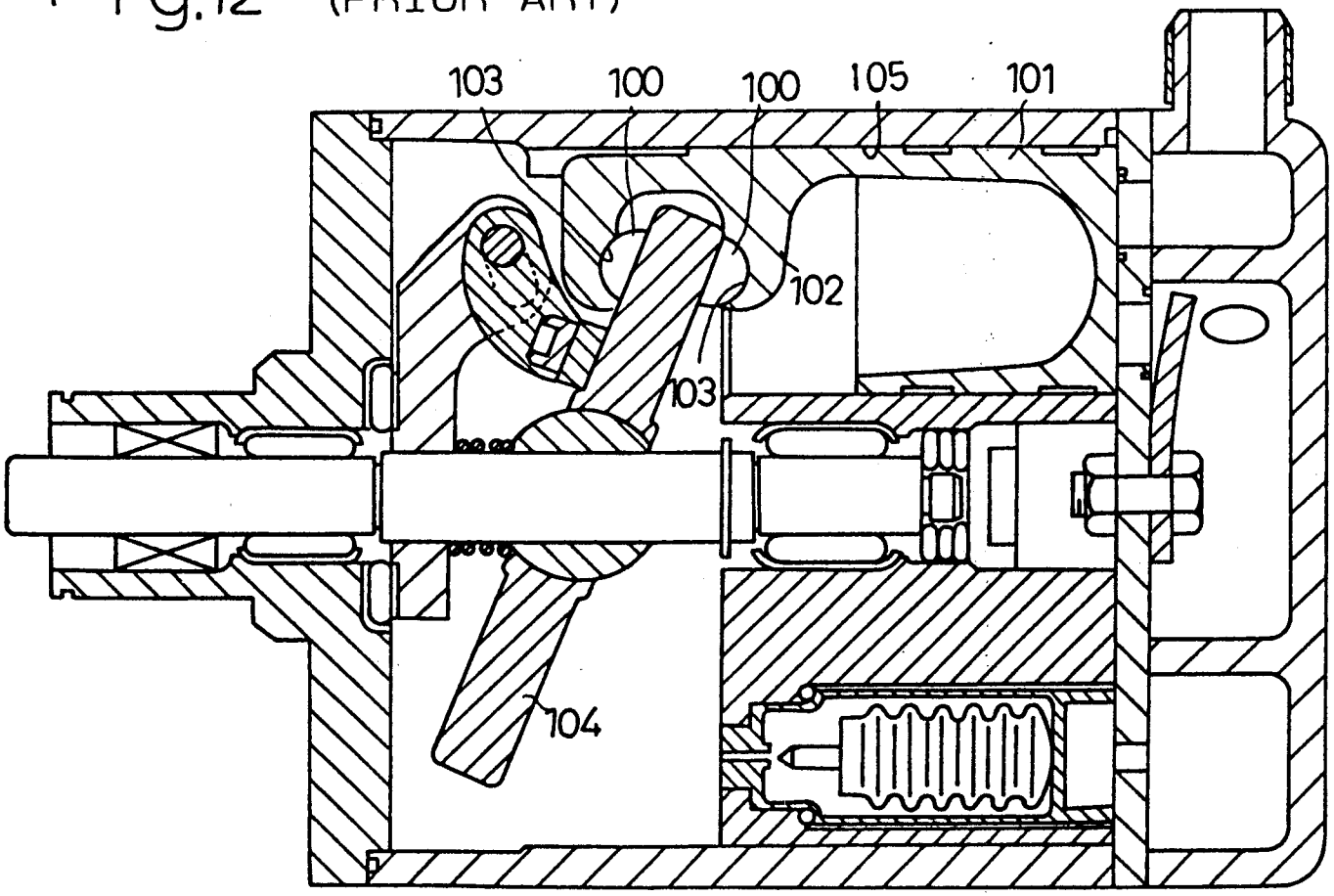
Fig.12 (PRIOR ART)
FIG. 12 is a side cross-sectional view of a conventional compressor.

The embodiment in FIG. 11 employs a combination of the second coupling member 15 in FIGS. 9 and 10 and a first coupling member 18 which is similar to the first coupling member 11 in FIG. 3.

Although only a few embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A swash plate type variable displacement compressor comprising;

a drive shaft;

a disk shaped swash plate pivotally mounted on the drive shaft for rotation together with the shaft;

a plurality of single head pistons, each piston being arranged to linearly reciprocate in accordance with the rotation of the swash plate;

first and second connecting members between said swash plate and each of said pistons, respectively, each said first connecting member movable in the radial direction relative to said drive shaft and each said second connecting member movable only in a direction perpendicular to the radial direction; and each said piston including a neck portion having an opening for receiving the first connecting member, said first connecting member being adapted to receive the second connecting member.

2. A variable displacement compressor as set forth in claim 1 further including a circular support rail formed on a peripheral portion of the swash plate, and a groove formed on each second connecting member for receiving said support rail in order to prevent radial movement of the second connecting member.

3. A variable displacement compressor as set forth in claim 2, wherein each said first connecting member includes a recess having a curved wall surface for receiving the second connecting member, wherein each second connecting member includes an outer curved surface, and wherein each said second connecting member outer curved surface is rotatable along said recess curved wall surface of the first connecting member.

4. A variable displacement compressor as set forth in claim 3, wherein each said piston includes an arcuate recess, and wherein each said first connecting member has an outer curved surface which engages said arcuate recess of its associated piston such that said first connecting member is slidable radially, and rotatable within the recess.

5. A variable displacement compressor as set forth in claim 3, wherein said recess of each said first connecting member is generally semi-cylindrical, and wherein each said second connecting member has a semi-cylindrical outer wall surface engaging said recess of its associated first connecting member.

6. A variable displacement compressor as set forth in claim 3, wherein said curved wall surface of each said first connecting member is semi-spherical, and wherein each said second connecting member has a semi-spherical outer wall surface engaging said semi-spherical wall surface of its associated first connecting member.

7. A variable displacement compressor as set forth in claim 2, wherein each said second connecting member includes an internal groove for receiving said support rail, said support rail being disposed on said swashplate at a radially inward location relative to said pistons.

* * * * *